US009561513B2

(12) United States Patent
Mackel et al.

(10) Patent No.: US 9,561,513 B2
(45) Date of Patent: Feb. 7, 2017

(54) METHOD FOR DISCHARGING A HEAVIER LIQUID PHASE BY ADJUSTING A DISCHARGE RADIUS BASED ON A VISCOSITY OF THE HEAVIER LIQUID PHASE

(75) Inventors: Wilfried Mackel, Lippetal-Herzfeld (DE); Klaus-Peter Eickhoff, Rheda-Wiedenbrueck (DE)

(73) Assignee: GEA Mechanical Equipment GmbH, Oelde (DE)

( * ) Notice: Subject to any disclaimer, the term of this patent is extended or adjusted under 35 U.S.C. 154(b) by 820 days.

(21) Appl. No.: 13/878,658

(22) PCT Filed: Oct. 10, 2011

(86) PCT No.: PCT/EP2011/067638

§ 371 (c)(1),
(2), (4) Date: Nov. 4, 2013

(87) PCT Pub. No.: WO2012/049118

PCT Pub. Date: Apr. 19, 2012

(65) Prior Publication Data

US 2014/0057772 A1 Feb. 27, 2014

(30) Foreign Application Priority Data

Oct. 14, 2010 (DE) ..... 10 2010 038 193

(51) Int. Cl.
*B04B 1/14* (2006.01)
*B04B 11/02* (2006.01)
(Continued)

(52) U.S. Cl.
CPC ..... *B04B 11/04* (2013.01); *B04B 1/14* (2013.01); *B04B 11/02* (2013.01); *B04B 11/082* (2013.01); *C11B 3/16* (2013.01)

(58) Field of Classification Search
CPC ..... B04B 1/12; B04B 1/14; B04B 11/02; B04B 11/04; B04B 11/08; B04B 11/082; C11B 3/16
(Continued)

(56) References Cited

U.S. PATENT DOCUMENTS 2,301,109 A * 11/1942 Clayton ..... B04B 1/08 494/27
3,494,544 A * 2/1970 Thylefors ..... B04B 1/10 494/1
4,594,166 A * 6/1986 Clinton ..... B04B 15/06 134/144

FOREIGN PATENT DOCUMENTS

DE 697 12 569 10/2002
DE 103 61 520 9/2005
(Continued)

OTHER PUBLICATIONS

German Search Report for Application No. 10 2010 038 193.4, dated Jul. 26, 2011.

*Primary Examiner* — Charles Cooley
*Assistant Examiner* — Shuyi S Liu
(74) *Attorney, Agent, or Firm* — Crowell & Moring LLP

(57) ABSTRACT

A method for the continuous processing of a product such as a vegetable or animal oil or fat. The processing occurs via a separation into two liquid phases and a solid phase. The method step includes processing the product, the processing occurring in a centrifuge arranged as a separator, the separator including a rotatable drum, a disk stack having risers arranged in the drum, a product feed having a feed tube, a first separator disk to discharge a lighter liquid phase from the drum, a second separator disk to discharge a heavier liquid phase from the drum, and a solids discharge opening
(Continued)

to discharge a solids phase from the drum. A separation zone is formed between the lighter phase and the heavier phase in the separator.

9 Claims, 2 Drawing Sheets

(51) Int. Cl.
*C11B 3/16* (2006.01)
*B04B 11/08* (2006.01)
*B04B 11/04* (2006.01)

(58) Field of Classification Search
USPC .... 494/37, 3, 56, 57, 67, 68, 70, 72, 74, 75, 494/79
See application file for complete search history.

(56) References Cited

FOREIGN PATENT DOCUMENTS

| | | | | |
|---|---|---|---|---|
| DE | 10 2005 021 331 | | 11/2006 | |
| RU | 2283698 | C2 * | 9/2006 | |
| WO | WO 8601436 | A1 * | 3/1986 | ..... B04B 1/14 |
| WO | 94/06565 | | 3/1994 | |

* cited by examiner

METHOD FOR DISCHARGING A HEAVIER LIQUID PHASE BY ADJUSTING A DISCHARGE RADIUS BASED ON A VISCOSITY OF THE HEAVIER LIQUID PHASE

CROSS-REFERENCE TO RELATED APPLICATION

This application is a national stage of International Application PCT/EP2011/067638, filed Oct. 10, 2011, and claims benefit of and priority to German Patent Application No. 10 2010 038 193.4, filed Oct. 14, 2010, the content of which Applications are incorporated by reference herein.

BACKGROUND AND SUMMARY

The present disclosure relates to a method for processing a product by phase separation. The present disclosure thus relates to a method for the continuous processing of a product such as a vegetable or animal oil or fat, the processing occurring via a separation into two liquid phases and a slides phase. The method step includes processing the product, the processing occurs in a centrifuge arranged as a separator, the separator including a rotatable drum, a disk stack having risers arranged in the drum, a product feed having a feed tube, a first separator disk to discharge a lighter liquid phase from the drum, a second separator disk to discharge a heavier liquid phase from the drum, a solids discharge opening to discharge a solids phase from the drum, and a separator zone formed between the lighter phase and the heavier phase in the separator.

DE 10 2005 021 331 A1, DE 697 12 569 T2 and WO 94/06 565 A1 are mentioned concerning the technological background. Although DE 10 2005 021 331 A1 shows a purifier, discharge of a heavier liquid phase occurs by an outlet to which a throttle device is assigned and only the discharge of a lighter liquid phase by a separation disk. WO 94/06 565 A1 discloses a purifier in which the lighter liquid phase occurs by a separation disk and the other, heavier liquid phase occurs by a discharge apparatus using small tubes obliquely adjustable in relation to the radial, which small tubes are set once to the desired radius, so that the discharge of this phase will always occur in operation, but such that only a part of the small tubes immerses into the heavy phase, which is intended to keep friction at a low level. DE 697 12 569 T2 discloses a purifier in which the lighter liquid phase occurs by a baffle plate and the other heavier liquid phase by an outlet element which is pressed by a drive apparatus to varying locations of a free liquid surface area. That is so that the discharge of this phase will also always occur in operation, wherein the immersion depth in this phase shall be kept constant to the highest possible extent in order to reduce power consumption. In accordance with DE 103 61 520 B2, blockages in the flow paths are prevented in processing by temporary displacement of the separation zone between skimmed milk and cream by throttling a valve or by increasing the feed capacity.

In the operation of purifiers, problems with the continuous discharge of the heavier phase will occur especially when the fraction of the heavier phase relative to the lighter phase is such that its viscosity in operation can increase strongly at a point in time that cannot be determined temporarily in a precise way.

Such an effect will occur, for example, in the processing of vegetable and animal oils and fats, which occurs in the separation of soapstock or mucilaginous substances, such as phosphatides.

These attendant materials strongly reduce the durability of oils and fats and should, therefore, be separated. There are hydratizable and non-hydratizable phosphatides. The attendant materials are removed, in that they are suitably treated and hydratized with acids, alkaline solutions, water and/or other substances. As a result, they lose their lipophil character, will become oil-insoluble, are precipitated from the oil and, after such pre-treatment, can, therefore, be separated in the separator.

The embodiments of the present disclosure address the solving of the above-noted problems and effects in a simple way.

Thus, embodiments of the present disclosure relate to a method for the continuous processing of a product such as a vegetable or animal oil or fat. The processing occurs via a separation into two liquid phases and a solids phase. The method steps include: processing the product, the processing occurring in a centrifuge arranged as a separator, the separator including a rotatable drum, a disk stack having risers arranged in the drum, a product feed having a feed tube, a first separator disk to discharge a lighter liquid phase from the drum, a second separator disk to discharge a heavier liquid phase from the drum, a solids discharge opening to discharge a solids phase from the drum, and a separator zone formed between the lighter phase and the heavier phase in the separator; and, adjusting a discharge radius from discharging the heavier liquid phase when a viscosity of the heavier liquid phase exceeds a limit value. Thus, when the viscosity of the heavier liquid phase HP increases substantially the inlet of the separator element for the heavier liquid phase is pivoted to a larger diameter in order to discharge the collected liquid phase of increased viscosity to a radius disposed further outside in the drum. After the discharge of the highly compacted liquid up to the radius set with the associated separator element, or disk, the separator element, or disk, will be set back a smaller radius again by discharging the heavier liquid phase.

The varying feed pressure in the product feed is determined as an indicator for the rise in the viscosity in the heavier liquid phase or the discharge pressure of the lighter liquid phase exceeds a threshold value, or if the gradient of the feed or discharge pressure is too large, the second separator element, or disk, will be adjusted to the above-mentioned larger radius.

Embodiments of the present disclosure are discussed herein and in the appended claims.

Other aspects of the present disclosure will become apparent from the following descriptions when considered in conjunction with the accompanying drawings.

DETAILED DESCRIPTION

Figure 1:
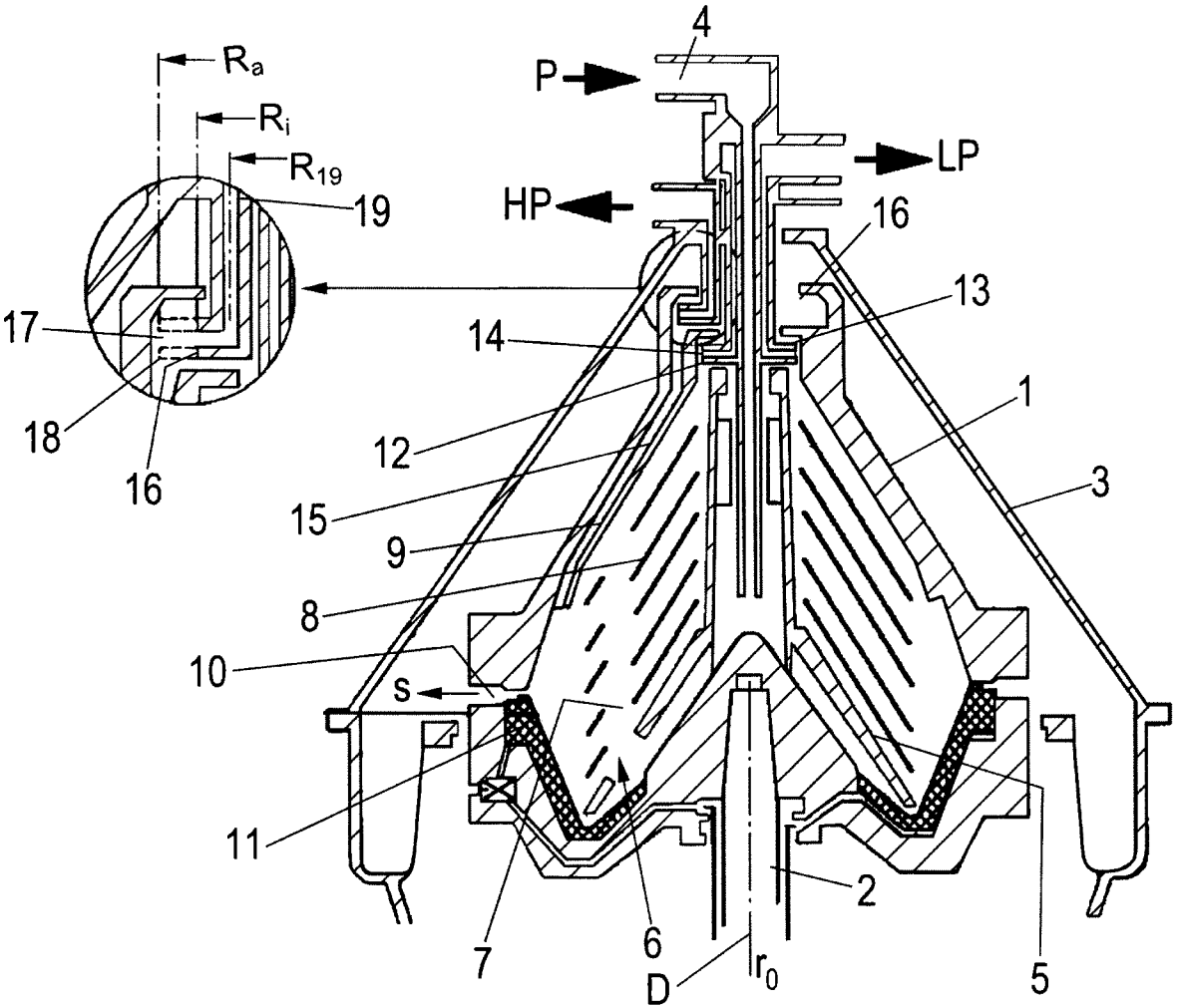
FIG. 1 shows a sectional view of a separator drum with a cap, in accordance with an embodiment of the present disclosure.

FIG. 1 shows a separator drum 1 which comprises a vertically aligned rotational axis D on the radius $r_0$.

The rotatable separator drum 1 is placed on a rotating spindle 2 which is driven directly or via a belt, for example, and which is rotatably held (not shown). The rotating spindle 2 may, for example, be provided with a conical configuration in its upper circumferential region. The separator drum 1 is enclosed by a stationary cap 3 which does not rotate with the drum 1.

In addition to this type of separator construction, constructions are also known in which a bottom drum is quasi "suspended" on an upper rotating spindle. In such a case, the drum will only be held in a rotating oscillating manner at only one of its ends or in connection to one of its axial ends.

The double conical separator drum 1 as shown in FIG. 1, includes a product feed tube 4 for a product feed P to be centrifuged, to which a distributor 5 is connected, which is provided with at least one, or, within the scope of the present disclosure, several outlet openings 6 through which incoming material to be centrifuged can be guided into the interior of the separator drum 1. Also provided is at least one riser 7 of a disk stack 8. Feeding through the spindle 2 from below, for example, is within the scope of the present disclosure.

The outlet openings 6 lie beneath the riser 7 in the disk stack 8 that includes conically shaped separator disks. The conical shape is not shown.

The disk stack 8 is closed off at the top by a separator disk 9 which has an even larger diameter than the disk stack 8.

A separation zone between a lighter liquid phase LP and a heavier liquid phase HP is formed within the disk stack 8, and may, for example, be within the riser 7 in operation during a respective rotation of the drum 1 at a specific radius. An emulsion line or separation line is also known as an E-line.

A solids phase is designated with reference letter S. It is discharged discontinuously through the solids discharge openings 10 which can be opened and closed discontinuously by a piston slide valve 11.

The lighter liquid phase LP, or light phase, will be guided on an inner radius $R_i$ into a separation chamber 12 and from there out of the drum 1 by the first separation element, or separation disk 13, also known as a gripper.

The separator disk 13 acts like a pump by the dynamic pressure caused by the rotational energy of the liquid. The separator disk 13 may include a valve (not shown) outside of the separator in its downstream discharge for throttling, for example.

The inlet 14 into the separator disk 13 is disposed on a fixed diameter which is not adjustable.

The heavy liquid phase HP, or heavy phase, on the other hand, flows about the outer circumference of the separator disk 9 through a discharge channel 15 into separator chamber 12 in which a second separator element, or disk, 16 is arranged.

Figure 2:
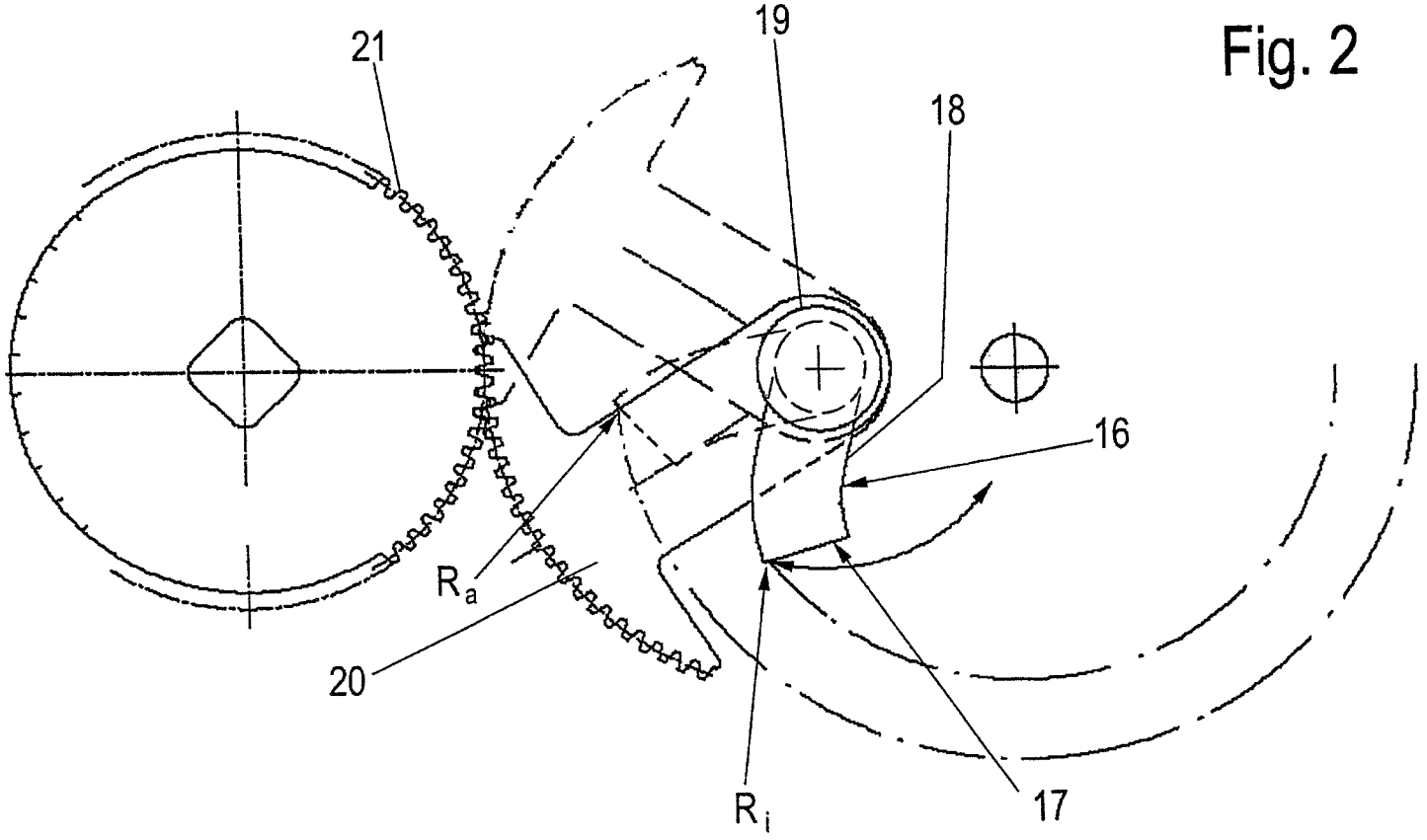
FIG. 2 shows a schematic view of the pivoting of a separation element, or disk, to different diameters, in accordance with an embodiment of the present disclosure.

This separator element, or disk, 16 is arranged in such a way that its inlet, or its inlet opening, 17 within the separator chamber 12 is continuously or discontinuously adjustable, for example, see FIG. 2 in this respect, so that at least one inner radius $R_i$ and one outer radius $R_a$ in the drum 1 can be reached.

This can be realized, for example, in such a way that the second separation element, or disk, 16 is arranged as a separation tube which is arranged in an L-shaped manner, as seen in FIG. 1, and includes a first section 18 which is radially aligned in the separation chamber 12 and a second section 19 which is aligned parallel to the rotational axis D and which is guided upwardly out of the rotating system, wherein the second section 19 is rotatable about its longitudinal axis on the radius $R_{19}$. A pivoting of the separator tube or first section 18 about the longitudinal rotational axis or radius $R_{19}$ (see FIG. 2) allows pivoting the inlet 17 between the inner radius $R_i$ and the outer radius $R_a$.

The pivoting can be realized in a large variety of ways, that is, by a toothed gearing, a lever mechanism, or by a hydraulic or pneumatic drive.

For this purpose, a gearing segment 20 can be arranged on the outside diameter of the tube, for example, which gearing segment 20 will, for example, mesh with a drive gearwheel 21 of a gear which is provided upstream with an electric motor (not shown). The drive and gear connection to the second separation element, or disk, 16 can also be realized in other ways, for example, but not shown here.

If the product to be processed is such that the viscosity of a heavier liquid phase HP will change unexpectedly in operation, especially, for example, increase considerably, clogging and blockage of the drum 1 can be prevented in such a way that the inlet of the separation element, or disk, 16 is pivoted to a larger diameter for the heavier liquid phase HP in order to discharge the compacted heavier liquid phase HP to a radius disposed further to the outside in the drum 1. The separation element, or disk, 16 will be moved back again to a smaller radius $R_i$ for discharging the heavier liquid phase HP after the discharge of this heavier liquid phase HP up to the outer radius $R_a$ set with the second separation element 16 or after the passage of a predetermined period of time.

The varying feed pressure in the product feed P or the discharge pressure of the lighter liquid phase LP can be determined as an indicator for the rise in the viscosity. If this pressure exceeds a threshold or limit value or if the gradient of the feed or discharge pressure is too large, the second separator element, or disk, 16 will be adjusted to the mentioned larger radius $R_a$.

Although the present disclosure has been described and illustrated in detail, it is to be clearly understood that this is done by way of illustration and example only and is not to be taken by way of limitation. The scope of the present disclosure is to be limited only by the terms of the appended claims.

We claim:

1. A method for the continuous processing of a product such as a vegetable or animal oil or fat, the processing occurring via a separation into two liquid phases and a solids phase, the method steps comprising:

processing the product, the processing occurring in a centrifuge arranged as a separator, the separator including a rotatable drum, a disk stack having risers arranged in the drum, a product feed having a feed tube, a first separator disk to discharge a lighter liquid phase from the drum, a second separator disk to discharge a heavier liquid phase from the drum, a solids discharge opening to discharge a solids phase from the drum, and a separator zone formed between the lighter phase and the heavier phase in the separator; and adjusting a discharge radius for discharging the heavier liquid phase when a viscosity of the heavier liquid phase exceeds a limit value;

wherein when the viscosity of the heavier liquid phase increases, an inlet of the second separator disk for discharging the heavier liquid phase is moved from a smaller radius to a larger radius in the drum, and after the discharge of the heavier liquid phase up to a radius that is reached with the second separator disk, the second separator disk is set back to the smaller radius in the drum.

2. The method according to claim 1, wherein a varying feed pressure in the product feed is determined and evaluated as an indicator for a rise in the viscosity in the heavier liquid phase.

3. A method for the continuous processing of a product such as a vegetable or animal oil or fat, the processing occurring via a separation into two liquid phases and a solids phase, the method steps comprising:

processing the product, the processing occurring in a centrifuge arranged as a separator, the separator including a rotatable drum, a disk stack having risers arranged in the drum, a product feed having a feed tube, a first separator disk to discharge a lighter liquid phase from the drum, a second separator disk to discharge a heavier liquid phase from the drum, a solids discharge opening to discharge a solids phase from the drum, and a separator zone formed between the lighter phase and the heavier phase in the separator; and adjusting a discharge radius for discharging the heavier liquid phase when a viscosity of the heavier liquid phase exceeds a limit value;

wherein a varying discharge pressure of the lighter liquid phase is determined and evaluated as an indicator for a rise in the viscosity in the heavier liquid phase.

4. The method according to claim 1, wherein the heavier liquid phase and the solids phase are discharged discontinuously from the drum.

5. The method according to claim 1, wherein the heavier liquid phase and the solids phase are discharged at different points in time from the drum.

6. The method according to claim 1, wherein at least phosphatides from the product feed are separated as part of the heavier liquid phase.

7. The method according to claim 3, wherein the heavier liquid phase and the solids phase are discharged discontinuously from the drum.

8. The method according to claim 3, wherein the heavier liquid phase and the solids phase are discharged at different points in time from the drum.

9. The method according to claim 3, wherein at least phosphatides from the product feed are separated as part of the heavier liquid phase.

* * * * *